United States Patent [19]

Rambacher

[11] Patent Number: 4,946,165

[45] Date of Patent: Aug. 7, 1990

[54] FOOTBALL HOLDER FOR PLACE-KICKING

[76] Inventor: Martin K. Rambacher, Maple Grove Rd., Bemus Point, N.Y. 14712

[21] Appl. No.: 356,934

[22] Filed: May 25, 1989

[51] Int. Cl.[5] ..... A63B 69/00
[52] U.S. Cl. ..... 273/55 B
[58] Field of Search ..... 273/55 B

[56] References Cited

U.S. PATENT DOCUMENTS

| | | | |
|---|---|---|---|
| 3,762,706 | 10/1973 | Cavett | 273/55 B |
| 3,897,948 | 8/1975 | Gerela | 273/55 B |
| 4,049,267 | 9/1977 | Forrest | 273/55 B |
| 4,477,077 | 10/1984 | Ferrebee | 273/55 B |
| 4,546,974 | 10/1985 | Brown | 273/55 B |
| 4,556,974 | 10/1985 | Brown | 273/55 B |
| 4,632,395 | 12/1986 | Ferrebee | 273/55 B |
| 4,634,122 | 1/1987 | Kline | 273/55 B |
| 4,807,880 | 2/1989 | Deal | 273/55 B |

*Primary Examiner*—T. Brown
*Attorney, Agent, or Firm*—Mason, Fenwick & Lawrence

[57] ABSTRACT

A football holder for place-kicking a regulation NFL type football comprises a base a vertical support member connected at its lower end to the base, a holding arm pivotably connected at its proximal end to the upper end of the support member for movement about a pivot axis perpendicular to the longitudinal axis of the holding arm, the lower surface of the holding arm at the distal end being adapted to engage a tip of the football, a stop member connected to the upper end of the support member to prevent the holding arm from rotating below a predetermined lowest position, and an adjustable tensioning mechanism for causing the holding arm to exert an adjustable amount of tension on the football. The lower surface of the holding arm at the distal end has attached thereto a foam rubber pad for contacting the tip of the football.

30 Claims, 3 Drawing Sheets

FOOTBALL HOLDER FOR PLACE-KICKING

BACKGROUND OF THE INVENTION

The present invention is directed to the field of football holders, and is more specifically directed to a football holder for place-kicking which closely simulates a person holding the football.

Place-kicking plays an important role in the game of football. It is therefore necessary for place-kickers to practice a great deal, in order to attain and maintain proficiency. However, the kicker requires the ball to be held in place he is kicking it for field goal practice. In order to enable the kicker to practice when a person to hold the ball is not available, various football kicking tees and holders have been devised.

One such device is that disclosed in U.S. Pat. No. 3,762,706 to Cavett. The Cavett device employs a lever arm pivotally mounted at one corner of a large, rectangular support base. The lever arm is provided with a retaining member for engaging the top surface of the ball, while the base is provided with a removable head on which to position the bottom surface of the ball. Although means are provided to adjust the tension exerted by the lever arm on the football, adjustment is a multi-step process which makes the device difficult to use. Also, the device as a whole is of limited value as the position and small size of the mounting pad allow for only minor angular adjustments of the football, and the requirement of placing the lower end of the football on the base prevents use of the device with a tee or with the ball on the ground or artificial turf, circumstances which are required if real game conditions are to be simulated. Furthermore, because of the relatively large size of the base and the mounting of the lever arm at a corner of the base, the device cannot be used by both left-and right-footed kickers.

Another football holding device is described in U.S. Pat. No. 4,546,974 to Brown. This device comprises a base portion, a support structure extending upwardly from the base, and a holding arm. The holding arm is pivotally attached under tension to the support structure. The end of the holding arm is provided with a downwardly projecting, pointed member which engages the seam of the football. As the tension on the holding arm itself is not adjustable, the support structure must be provided with means for adjusting its height, in order to accommodate a football positioned at an angle or to adjust the tension exerted by the holding arm on the football. Moreover, the member projecting into the seam of the football creates a substantial drag on the ball when it is kicked, so that the device cannot simulate actual playing conditions wherein a person lightly holds the football in position with his index finger.

A number of football holding devices have been provided wherein a holding arm is supported by a base and the end of the holding arm is positioned above the base. In these devices, one end of the football is placed o the base and the other end of the football is placed under the holding arm. Such devices are shown in U.S. Pat. No. 4,049,267 to Forrest, U.S. Pat. No. 4,634,122 to Kline, and U.S. Pat. No. 4,807,880 to Deal. The requirement that one end of the football be placed on the base precludes the use of these devices with the ball engaging the ground or artificial surface.

U.S. Pat. No. 3,897,948 to Gerela also discloses a device wherein a holding arm is supported by a base, but the end of the holding arm extends beyond the base. Although the position of the arm is adjustable, there is no actual mechanism for adjusting the tension exerted by the arm.

U.S. Pat. Nos. 4,477,077 and 4,632,395 to Ferrebee disclose football holders comprising a base and a series of pivotable arm elements mounted to the base, the outermost arm element of which terminates in a point for engaging one end of the football. Although the extension of the pivotable arm elements beyond the base would permit these devices to be used with a conventional kicking tee, these devices have certain disadvantages. For example, the tension applied to the football by the arm elements is adjusted by varying the positions of the arm elements, which is a complicated and time-consuming procedure. Also, the use of the pointed end to engage the football results in the same undesirable drag on the upper end of the ball as is present in the device of Brown.

In summary, no football holder for place-kicking exists which both simulate the holding action of a real person and eliminates the disadvantages of the prior art devices. It is the solution of these and other problems to which the present invention is directed.

SUMMARY OF THE INVENTION

Therefore, it is the primary object of this invention to provide a football holding device for place-kicking which closely simulates the holding action of a real person.

It is another object of this invention to provide a football holding device for place-kicking in which the tension on the football is adjustable.

It is another object of this invention to provide a football holding device for place-kicking which can accommodate a football in either an upright or an angled position.

It is still another object of this invention to provide a football holding device for place-kicking which is usable with or without a conventional kicking tee, or with tees of different sizes based on the differences in rules used at the high school, collegiate, and professional levels.

It is still another object of this invention to provide a football holding device for place-kicking which is usable by both left or right footed kickers and by both straight-ahead (conventional) and soccer-style kickers.

It is yet another object of this invention to provide a football holding device for place-kicking which is usable on both natural and artificial surfaces.

The foregoing and other objects of the invention are achieved by provision of a football holder for place-kicking comprising a base adapted to rest on a playing surface, a vertical support member connected at its lower end to the base and extending upwardly from the base, a holding arm pivotably connected at its proximal end to the upper end of the support member for movement about a pivot axis perpendicular to the longitudinal axis of the holding arm, the lower surface of the holding arm at the distal end being adapted to engage a tip of the football, a stop member connected to the upper end of the support member to prevent the holding arm from rotating below a predetermined lowest position, and an adjustable tensioning mechanism for causing the holding arm to exert an adjustable amount of tension on the football. The tensioning mechanism comprises a resilient biasing mechanism for biasing the holding arm towards its predetermined lowest position and an adjustment mechanism acting on the biasing mechanism for adjusting the holding arm to a range of positions above the predetermined lowest position, whereby the tension exerted by the holding arm on the football can be adjusted.

In one aspect of the invention, the lower surface of the holding arm at the distal end has attached thereto a foam rubber pad having planar surface for lightly contacting the tip of the football.

In another aspect of the invention, the biasing mechanism comprises a stud having a head and a stem, the stem being positioned in an aperture in the holding arm for reciprocating, sliding motion therein perpendicular to the longitudinal axis of the holding arm, and a helical spring mounted around the stem between the head and the upper surface of the holding arm. The adjustment mechanism comprises a screw rotatably mounted in the stop member for rotational motion about a vertical axis, the screw being positioned in the stop member so that its lower end engages the upper surface of the head of the stud. The adjustment mechanism can further comprise a knob attached to the upper end of the screw for turning the screw and a helical spring mounted around the screw below the knob for providing tension on the knob.

In yet another aspect of the invention, the stop member is attached to the upper end of the support member above the holding arm.

In yet another aspect of the invention, the base comprises a circular central portion and at least three equally-spaced legs extending radially therefrom. The base has a center, the lower end of the support member being connected to the center of the base. Also, the distal end of the holding arm extends beyond the perimeter of the base, whereby when one end of the football is placed under the distal end of the holding arm, the other end of the football is clear of the base.

A better understanding of the disclosed embodiment of the invention will be achieved when the accompanying detailed description is considered in conjunction with the appended drawings, in which like reference numerals are used for the same parts as illustrated in the different figures.

DESCRIPTION OF A PREFERRED EMBODIMENT

Figure 1:
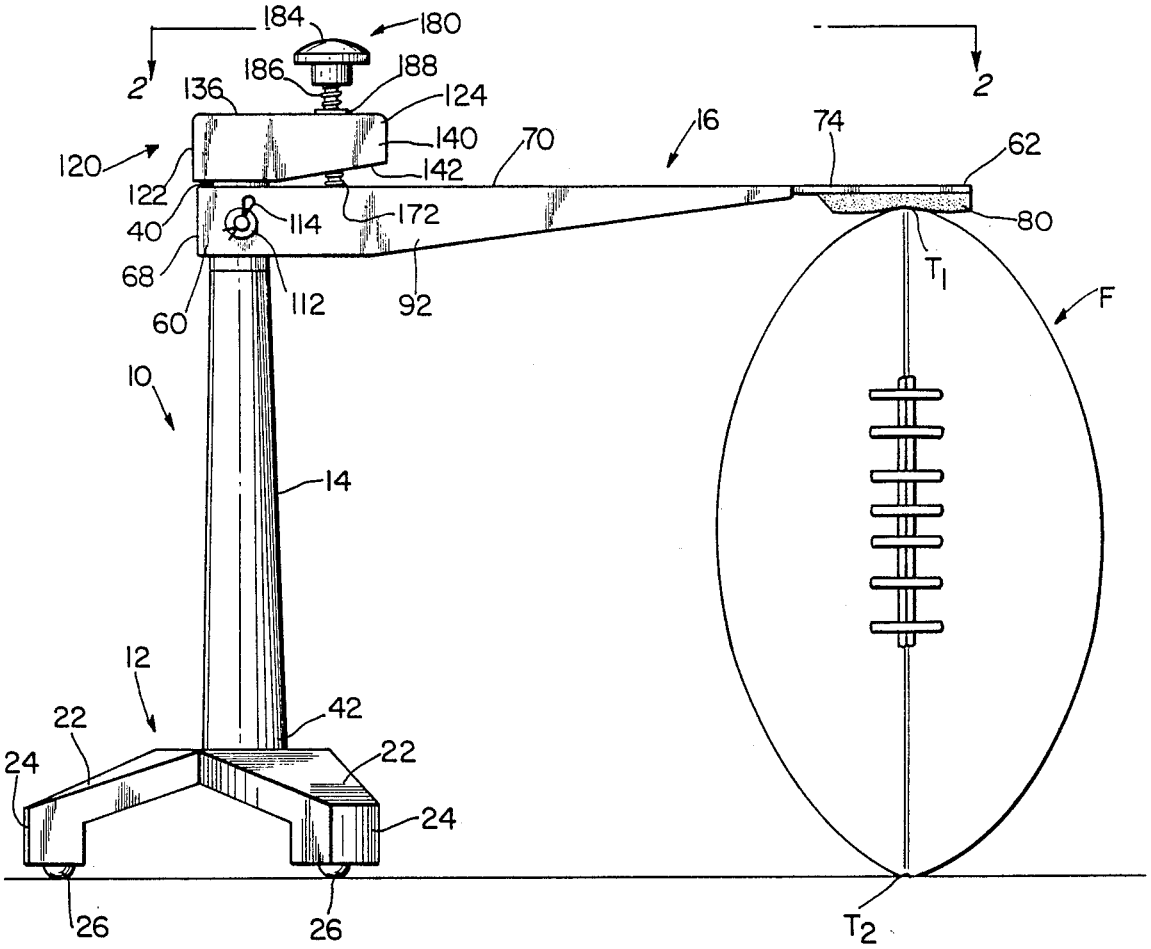
FIG. 1 is a side elevational the football holder for place-kicking a regulation NFL type football according to the preferred embodiment of the invention, in use holding a football in an upright position.
Figure 2:
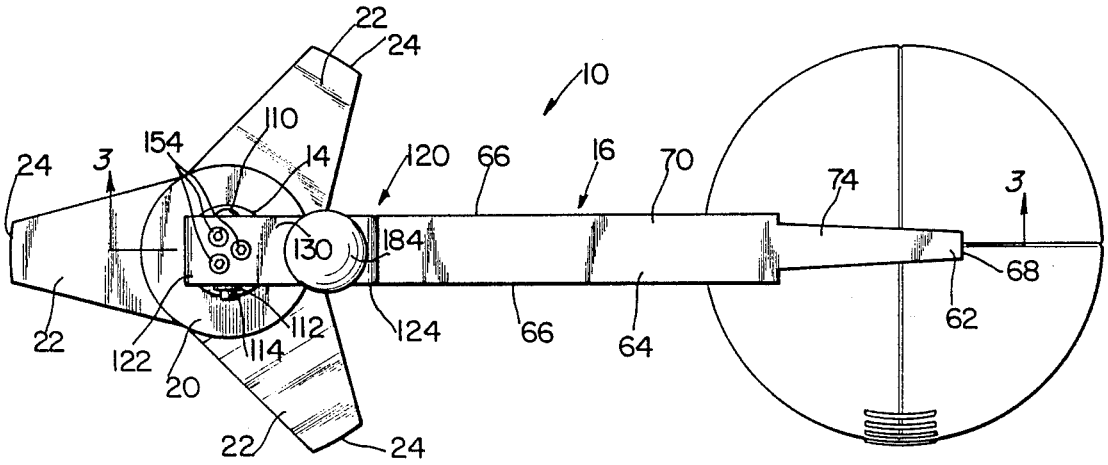
FIG. 2 is a top plan view of the football holder of FIG. 1.
Figure 3:
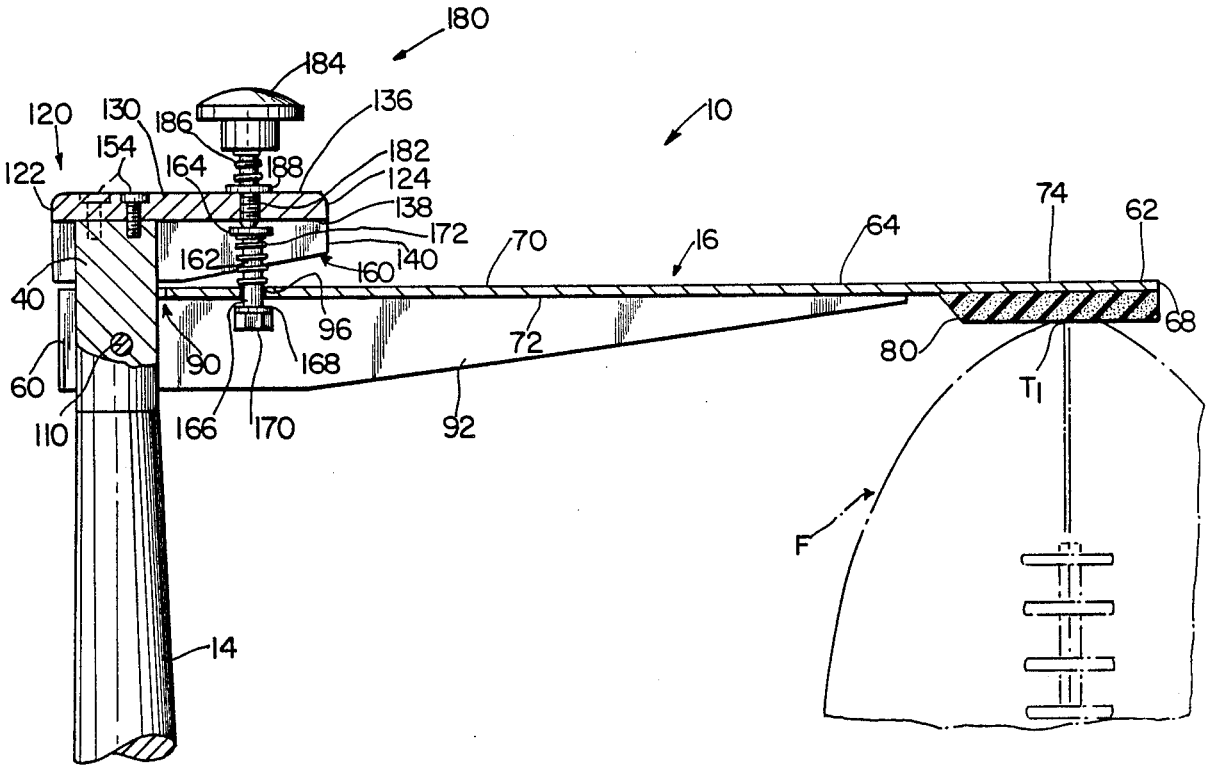
FIG. 3 is a cross-sectional view of the football holder of FIG. 1, taken along line 3—3 of FIG. 2.
Figure 4:
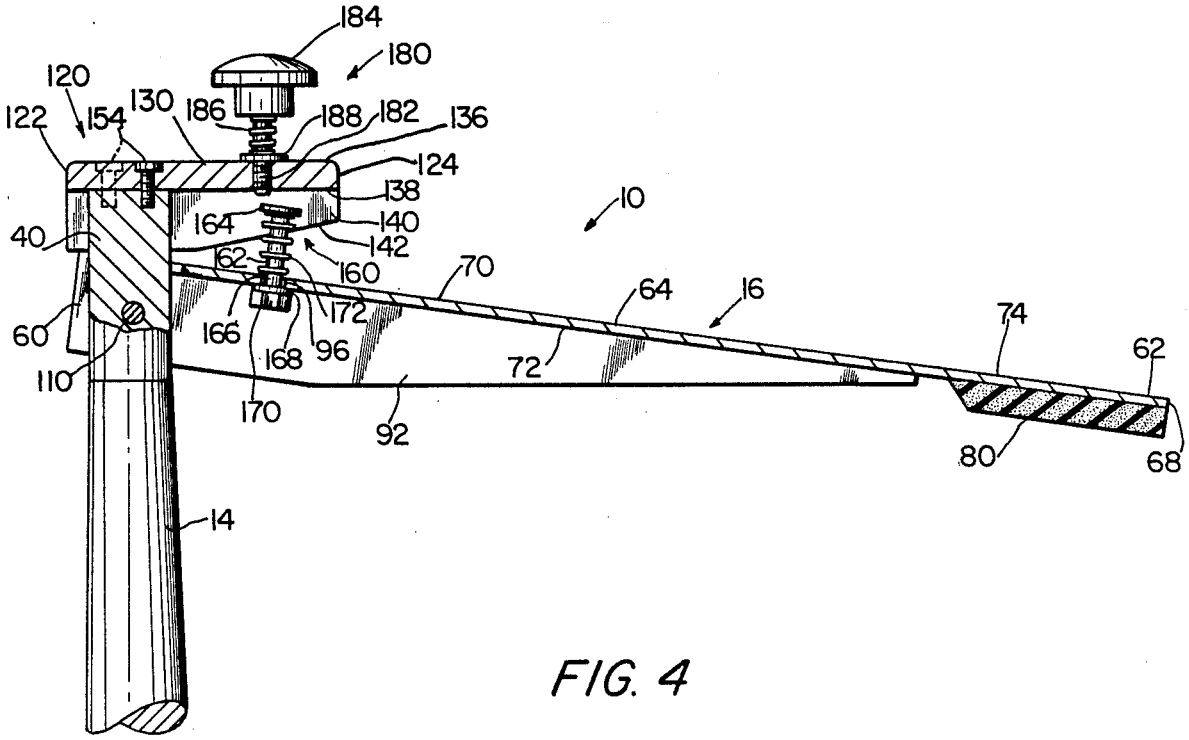
FIG. 4 is a cross-sectional view of the football holder of FIG. 1, with the holding arm disengaged.
Figure 5:
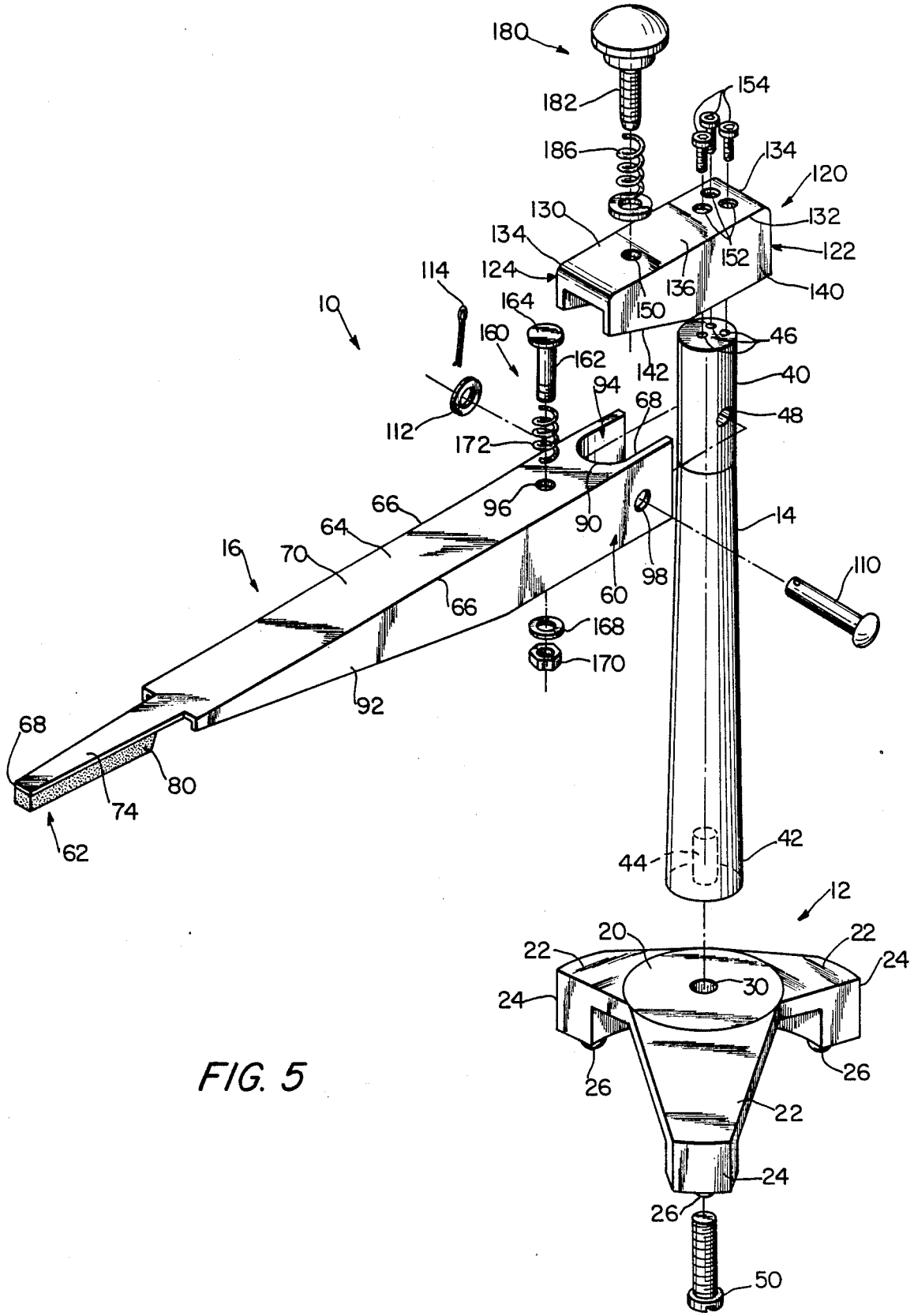
FIG. 5 is an exploded perspective view of the football holder of FIG. 1.

Referring now to FIGS. 1-5, there is shown a football holder 10 according to the invention for holding a football F for place-kicking. Football holder 10 comprises a base 12, a vertical support member 14, and a holding arm 16, all of which are of substantially rigid construction. Base 12, support member 14, and holding arm 16 can be made of molded plastic or any other suitable material. For example, support member 14 can also be made of metal, and preferably a metal which is rustproof so as to be usable outdoors in wet conditions.

Base 12 comprises a circular center portion 20 (FIG. 5) having three equally-spaced legs 22 extending radially outwardly therefrom and adapted to rest on the playing surface. The ends 24 of legs 22 define the perimeter of base 12. Rounded tips 26 can be provided on the bottoms of legs 22 at their ends 24. A circular aperture 30 extends through the center of center portion 20, for a purpose to be de hereinafter.

Support member 14 has upper end 40 and a lower end 42, and preferably has a transverse cross-section. A threaded axial bore 44 extends into lower end 42, and three spaced-apart, threaded, parallel, longitudinal bores 46 extend into upper end 40. A cylindrical bore 48 perpendicular to the longitudinal axis of member 14 extends through support member 14 adjacent end 40. Support member 14 is secured to base 12 by a screw 50 inserted through aperture 30 in base 12 and into threaded bore 44 in support member 14.

It should be understood such designations as upper and lower are arbitrary and the orientation shown in the drawings, with "lower" refer the end of support member 14, for example, which is closes the playing surface.

Holding arm 16 has a proximal end 60 and a distal end 62 (FIG. 3) comprises a planar transverse wall 64 having opposed sides 66, opposed ends 68, upper surface 70, and a lower surface 72. Sides 66 are at distal end 62 to define a finger 74. A pad 80 formed a flexible and resilient material such as foam rubber is to the lower surface 72 of transverse wall 64 at finger 74 for a purpose to be described hereinafter. A U-shaped 90 is provided at the end 68 adjacent proximal end 60 wall 64. Planar side walls 92 extend perpendicular to and downwardly from edges 60 of transverse wall 64. Notch 90 and side walls 92 define a yoke 94 (FIG. 5) at distal end 62 of holding arm 60 for receiving support member 14. A circular aperture 96 is provided through transverse wall 64 adjacent notch 90, also for a purpose to be described hereinafter.

Side walls 92 are provided with coaxial circular apertures 98 therethrough at proximal end 60. Circular apertures 98 are placed in registration with bore 48 in support member 14, and holding arm 16 is pivotally attached to support member 14 by a pin 110 inserted through apertures 98 and bore 48. Pin 110 is held in place by a washer 112 and a cotter pin 114. Notch 90 is cut sufficiently deep into proximal end 60 of holding arm 16 to provide a gap between notch 90 and the surface of support member 14, so as to allow holding arm 16 to pivot freely. It will be appreciated that notch 90 could be rectangular in shape if support member 14 had a square transverse cross-section. Other configurations for notch 90 and the transverse cross-section of support member 14 will also occur to those of skill in the art.

In order to prevent holding ar 16 from pivoting downwardly into an almost-vertical position, a stop member 120 (FIG. 3) is provided immediately above holding arm 16 at the upper end 40 of support member 14. Stop member 120 has a proximal end 122 and a distal end 124 and comprises a horizontal wall 130 having opposed sides 132, opposed ends 134, an upper surface 136, and a lower surface 138. Side walls 140 extend perpendicularly downward from sides 132 of horizontal wall 130.

The width of horizontal wall 130 is substantially the same as the width of transverse wall 64 of holding arm 16 so that the bottom edges 142 of side walls 140 can engage the upper surface 70 of transverse wall 64 at its proximal end 60. The bottom edges 142 of side walls 140 are angled upwardly towards horizontal wall 130 at distal end 124, to allow holding arm 16 to pivot upwardly a limited distance, while bottom edges 142 extend horizontally at proximal end 122 to prevent holding arm 16 from pivoting downwardly below a predetermined position. Horizontal wall 130 is provided with a threaded circular aperture 150 at distal end 124, for a purpose to be described hereinafter, and with three circular apertures 152 at proximal end 122 which are positioned to register with bores 46 extending into upper end 40 of support member 14. Stop member 120 is attached to the upper end 40 of support member 14 by three threaded screws 154 inserted through circular apertures 152 and into bores 46 in support member 14.

Tensioning means are provided to adjust the tension exerted on the football by holding arm 16. The tensioning means comprises a biasing means 160 comprising a threaded stud 162 having a head 164 and a stem 166. Stud 162 is positioned in aperture 96 of holding arm 16 for sliding movement along its longitudinal axis. A washer 168 and nut 170 retain stud 162 in aperture 96. A helical spring 172 is mounted around stem 166 of stud 162 between its head 164 and upper surface 70 of transverse wall 64 of holding arm 16 to bias stud 162 into a fully extended position above upper surface 70.

The tensioning means further comprises an adjustment means 180 comprising a screw 182 having a knob 184 mounted thereon. Screw 182 engages threaded aperture 150 in stop member 120 for rotational motion about a vertical axis. A helical spring 186 and a nut 188 are mounted around screw 182 between knob 184 and upper surface 136 of horizontal Wall 130 of stop member 120. Threaded aperture 150 is so positioned that screw 182 will contact head 164 of stud 162 when screw 182 is rotated clockwise.

In operation, base 12 of football holder 10 is placed on the playing surface with the football F under finger 74 of holding arm 16 and contacting the foam rubber pad 80. The texture and resilience of pad 80 aid in simulating the amount of friction and pressure provided by the finger of a human ball holder.

Once the desired angular position of football F has been set, knob 184 is turned clockwise or counterclockwise to cause screw 182 to move downwardly or upwardly within aperture 150 of stop member 120. Because screw 182 contacts head 164 of stud 162, stud 162 will be driVen down or up depending upon the direction in which screw 182 is driven, thereby adjusting the tension provided by holding arm 16. If screw 182 is fully rotated in the counterclockwise direction, it will no longer contact head 164 of stud 162, and holding arm 16 Will be retained in a predetermined lower position by the lower edges 142 of side walls 140 of stop member 120 at distal end 122. If screw 182 is fully rotated in the clockwise direction, it will depress stud 162 to the greatest extent possible, providing the greatest available tension on football F.

The length of holding arm 16 relative to the width or radius of base 12 is such that when one tip or end T1 of football F is placed under finger 74, the other tip or end T2 will clear base 12, regardless of the angular orientation of the football. In this way, room is provided adjacent base 12 for use of a conventional kicking tee in conjunction with the football holder 10. Moreover, because of this lateral clearance between finger 74 and base 12, there will be clearance between the foot of the kicker and the perimeter of base 12 so that the football holder 10 is adapted for use by either right-or left-footed kickers and by both soccer-style and straight ahead kickers. Also, the configuration of base 12 allows football holder 10 to be used on both natural and artificial playing surfaces.

Thus, it will be seen that the present invention provides a unique method of holding a football for place-kicking in which the tension exerted on the football can be adjusted with a minimum of effort. Moreover, the operation of the device is both effective and easy to accomplish, so as to render its use convenient to users. While a preferred embodiment of the invention has been disclosed, it should be understood that the spirit and scope of the invention is to be limited solely by the appended claims, since numerous modifications of the disclosed embodiment will undoubtedly occur to those of skill in the art.

I claim:

1. A football holder for place kicking a regulation NFL type football comprising:

a base adapted to rest on a playing surface;

a vertical support member having an upper end and a lower end, said support member being connected to said base at said lower end of said support member, and said support member extending upwardly from said base;

a holding arm having a longitudinal axis, a distal end, and a proximal end, an upper surface and a lower surface, said proximal end being pivotally connected to said upper end of said support member for movement about a pivot axis perpendicular to said longitudinal axis of said holding arm, and said lower surface at said distal end being adapted to engage a tip of the football;

stop means connected to said upper end of said support member to prevent said holding arm from rotating below a predetermined lowest position; and adjustable tensioning means for causing said holding arm to exert an adjustable amount of tension on the football, said tensioning means comprising resilient biasing means for biasing said holding arm towards said predetermined lowest position and adjustment means acting on said biasing means for adjusting said holding arm to a range of positions above said predetermined lowest position, whereby the tension exerted by said holding arm on the football can be adjusted;

said holding arm being provided with an aperture therethrough adjacent said proximal end and said biasing means comprising:

a stud having a head and a stem, said stem being positioned in said aperture in said holding arm for reciprocating, sliding motion therein perpendicular to said longitudinal axis of said holding arm; and a helical spring mounted around said stem between said head and said upper surface of said holding arm.

2. The football holder of claim 1, said lower surface of said holding arm at said distal end having attached thereto a foam rubber tip having a planar surface for contacting the tip of the football.

3. The football holder of claim 1, said head of said stud having an upper surface and said adjustment means comprising a screw mounted in said stop means for rotational motion about a vertical axis said screw having an upper end and a lower end and being positioned in said stop means so that said lower end of said screw engages said upper surface of said head of said stud.

4. The football holder of claim 3, said adjustment means further comprising knob means attached to said upper end of said screw for turning said screw and a helical spring mounted around said screw below said knob means for providing tension on said knob means.

5. The football of claim 1, said base comprising a circular central portion and at least three equally-spaced legs extending radially therefrom.

6. The football holder of claim 1, said base having a center and said lower end of said support member being connected to said center of said base.

7. The football holder of claim 1, said base having a perimeter and said distal end of said holding arm extending beyond said perimeter of said base, whereby when one tip of the football is placed under said proximal end, the other tip of the football is clear of said base.

8. The football holder of claim 1, said proximal end of said holding arm having a yoke formed therein for receiving said support member.

9. A football holder for place kicking a regulation NFL type football comprising:

a base adapted to rest on a playing surface;

a vertical support member having an upper end and a lower end, said support member being connected to said base at said lower end of said support member, and said support member extending upwardly from said base;

a holding arm having a longitudinal axis, a distal end, and a proximal end, an upper surface and a lower surface, said proximal end being pivotally connected to said upper end of said support member for movement about a pivot axis perpendicular to said longitudinal axis of said holding arm, and said lower surface at said distal end being adapted to engage a tip of the football;

stop means connected to said upper end of said support member to prevent said holding arm from rotating below a predetermined lowest position, said stop means being attached to said upper end of said support member above said holding arm;

adjustable tensioning means for causing said holding arm to exert an adjustable amount of tension on the football, said tensioning means comprising resilient biasing means for biasing said holding arm towards said predetermined lowest position and adjustment means acting on said biasing means for adjusting said holding arm to a range of positions above said predetermined lowest position, whereby the tension exerted by said holding arm on the football can be adjusted, said adjustment means being carried by said stop means.

10. The football holder of claim 9, said lower surface of said holding arm at said distal end having attached thereto a foam rubber tip having a planar surface for contacting the tip of the football.

11. The football holder of claim 9, said base comprising a circular central portion and at least three equally-spaced legs extending radially therefrom.

12. The football holder of claim 9, said base having a center and said lower end of said support member being connected to said center of said base.

13. The football holder of claim 9, said base having a perimeter and said distal end of said holding arm extending beyond said perimeter of said base, whereby when one tip of the football is placed under said proximal end, the other tip of the football is clear of said base.

14. The football holder of claim 9, said proximal end of said holding arm having a yoke formed therein for receiving said support member.

15. A football holder for place-kicking a regulation NFL type football comprising:

a base adapted to rest on a playing surface;

a vertical support member having an upper end and a lower end, said support member being connected to said base at said lower end of said support member, and said support member extending upwardly from said base;

a holding arm having a longitudinal axis, a distal end and a proximal end, and upper surface, and a lower surface, and being provided with an aperture therethrough adjacent said proximal end, said proximal end being pivotably connected to said upper end of said support member for movement about a pivot axis perpendicular to said longitudinal axis of said holding arm, and said lower surface at said distal end being adapted to engage a tip of the football;

stop means connected to said upper end of said support member above said holding arm to prevent said holding arm from rotating below a predetermined lowest position; and a biasing assembly comprising a stud and a helical spring, said stud having a head and a stem, said head having an upper surface, said stem being positioned in said aperture in said holding arm for reciprocating, sliding motion therein perpendicular to said longitudinal axis of said holding arm, and said helical spring being mounted around said stem between said head and said upper surface of said holding arm; and a screw mounted in said stop means for rotational motion about a vertical axis, said screw having an upper end and a lower end and being positioned in said stop means so that said lower end of said screw engages said upper surface of said head of said stud.

16. The football holder of claim 15, said lower surface of said holding arm at said distal end having attached thereto a foam rubber pad having a planar surface for contacting the tip of the football.

17. The football holder of claim 15, said adjustment means further comprising knob means attached to said upper end of said screw for turning said screw and a helical spring mounted around said screw below said knob means for providing tension on said knob means.

18. The football holder of claim 15, said base comprising a circular central portion and at least three equally-spaced legs extending radially therefrom.

19. The football holder of claim 15, said base having a center and said lower end of said support member being connected to said center of said base.

20. The football holder of claim 15, said base having a perimeter and said distal end of said holding arm extending beyond said perimeter of said base, whereby when one tip of the football is place under said proximal end, the other tip of the football is clear of said base.

21. The football holder of claim 15, said proximal end of said holding arm having a yoke formed therein for receiving said support member.

22. A football holder for place kicking a regulation NFL type football comprising:

a base adapted to rest on a playing surface;

a vertical support member having an upper end and a lower end, said support member being connected to said base at said lower end of said support member, and said support member extending upwardly form said base;

a holding arm having a longitudinal axis, a distal end, and a proximal end, an upper surface and a lower surface, and a finger formed at said distal end, said proximal end being pivotally connected to said upper end of said support member for movement about a pivot axis perpendicular to said longitudinal axis of said holding arm, and said lower surface at said finger having attached thereto a flexible and resilient tip adapted to engage a tip of the football;

stop means connected to said upper end of said support member to prevent said holding arm form rotating below a predetermined lowest position; and adjustable tensioning means for causing said holding arm to exert an adjustable amount of tension on the football, said tensioning means comprising resilient biasing means for biasing said holding arm towards said predetermined lowest position and adjustment means acting on said biasing means for adjusting said holding arm to a range of positions above said predetermined lowest position, whereby the tension exerted by said holding arm on the football can be adjusted;

said holding arm being provided with an aperture therethrough adjacent said proximal end and said biasing means comprising:

a stud having a head and a stem, said stem being positioned in said aperture in said holding arm for reciprocating, sliding motion therein perpendicular to said longitudinal axis of said holding arm; and a helical spring mounted around said stem between said head and said upper surface of said holding arm.

23. The football holder of claim 22, said flexible and resilient tip being formed from foam rubber and having a planar surface for contacting the tip of the football.

24. The football holder of claim 22, said stop means being attached to said upper end of said support member above said holding arm, said adjustment means being carried by said stop means.

25. The football holder of claim 22, said head of said stud having an upper surface and said adjustment means comprising a screw mounted in said stop means for rotational motion about a vertical axis, said screw having an upper end and a lower end and being positioned in said stop means so that said lower end of said screw engages said upper surface of said head of said stud.

26. The football holder of claim 25, said adjustment means further comprising knob means attached to said upper end of said screw for turning said screw and a helical spring mounted around said screw below said knob means for providing tension on said knob means.

27. The football holder of claim 22, said base comprising a circular central portion and at least three equally-spaced legs extending radially therefrom.

28. The football holder of claim 22, said base having a center and said lower end of said support member being connected to said center of said base.

29. The football holder of claim 22, said base having a perimeter and said distal end of said holding arm extending beyond said perimeter of said base, whereby when one tip of the football is place under said proximal end, the other tip of the football is clear of said base.

30. The football holder of claim 22, said proximal end of said holding arm having a yoke formed therein for receiving said support member.

* * * * *